United States Patent [19]

Moroi et al.

[11] Patent Number: 4,630,182

[45] Date of Patent: Dec. 16, 1986

[54] ILLUMINATING SYSTEM

[75] Inventors: Akihiko Moroi, Fujisawa; Hiroshi Tanaka, Yokohama; Shinya Hatanaka, Kawasaki, all of Japan

[73] Assignee: Nippon Kogaku K. K., Tokyo, Japan

[21] Appl. No.: 708,405

[22] Filed: Mar. 5, 1985

[30] Foreign Application Priority Data

Mar. 6, 1984 [JP] Japan ..... 59-42471

[51] Int. Cl.[4] ..... F21V 29/00

[52] U.S. Cl. ..... 362/294; 362/345; 362/347; 362/373

[58] Field of Search ..... 362/373, 345, 347, 350, 362/294

[56] References Cited

U.S. PATENT DOCUMENTS 3,703,635 11/1972 Burkarth ..... 362/264
3,864,547 2/1975 Ray ..... 362/294

FOREIGN PATENT DOCUMENTS 1957910 3/1983 Fed. Rep. of Germany ..... 362/345
144168 11/1980 Japan ..... 362/345
919950 2/1963 United Kingdom ..... 362/373
952274 3/1964 United Kingdom ..... 362/373

*Primary Examiner*—E. Rollins Cross
*Attorney, Agent, or Firm*—Shapiro and Shapiro

[57] ABSTRACT

An illuminating system for generating a high-intensity illuminating light utilizing a lamp of short arc type is equipped with a cooling device capable of effectively cooling the arc lamp and the reflecting optical members with an extremely simple structure. The illuminating system comprises a lamp emitting illuminating light of a high intensity; a reflecting optical member provided with a reflecting face surrounding the lamp and further provided at an end with a window for transmitting the light from the reflecting face and at the other end with an aperture for passing a part of the lamp; a casing integrally housing the reflecting optical member and the lamp and provided with a ventilating hole in a part of the casing for communication with the exterior; and air guide means for connecting the ventilating hole with an air path connecting the light transmitting window of the reflecting optical member with the aperture thereof.

4 Claims, 4 Drawing Figures

ILLUMINATING SYSTEM

BACKGROUND OF THE INVENTION

1. Field of the Invention

The present invention relates to an illuminating system for generating a high-intensity illuminating light utilizing a lamp of the short arc type, and more particularly to a cooling structure for such illuminating system.

2. Description of the Prior Art

Mercury lamps of the short arc type are often employed in apparatus for exposing a photosensitive material to high-intensity light. Such lamp, generally capable of emitting light of a determined wavelength with a high efficiency, is suitable as a light source of an exposure apparatus for transferring the pattern of a photomask onto a semiconductor wafer. However such arc lamp consumes a large electric power, so that the discharge electrode, lamp wall housing the discharge electrode and metal mount of the lamp often reach a high temperature in the order of 200° to 500° C. particularly in case a spheroidal reflector is employed for efficiently concentrating the light from the arc lamp, the temperature rise becomes even larger and may lead to the destruction of the arc lamp unless suitable cooling system is provided, since the spheroidal reflector is positioned to surround the lamp. For achieving such cooling, the Japanese Patent Publication No. 43226/1980 discloses a method of blowing cooling air from a nozzle to the metal mount of the lamp and to so intercept the cooling air as not to reach the lamp wall. However, if the average input electric power to the arc lamp fluctuates, the metal mount and the lamp wall show considerable variation in temperature, and, in the above-described method, it becomes necessary to blow the cooling air of a corresponding amount from the nozzle. Although it is possible to automatically control the amount of air supplied from the nozzle by detecting the temperature of the metal mount and the lamp wall, a large amount of air is required if the temperature of the metal mount rises, and the apparatus becomes inevitably large because of the requirement for a high-capacity source for compressed air such as a compressor. Experiments conducted by the present inventors have revealed that a flow rate of several liters per minute is required to satisfactorily cool the lamp wall or metal mount in case the temperature thereof reaches 100° C. or so. Dusts of several microns, sometimes those as small as one micron cannot be tolerated in the exposure apparatus for semiconductor device manufacture. However the use of a large amount of cooling air as in the above-described prior art often gives rise to the involvement of dusts of untolerable size, and is therefore undesirable for the exposure apparatus in the field of semiconductor device manufacture. Besides, as the nozzle is directed to the metal mount of the lamp, this method is effective for cooling the arc lamp alone but is not effective for cooling the entire illuminating system including the spheroidal reflector.

SUMMARY OF THE INVENTION

In consideration of the foregoing, the present invention is to provide an illuminating system equipped with a cooling device capable of effectively cooling the arc lamp and the reflecting optical members with an extremely simple structure.

The above-mentioned object of the present invention is achieved by an illuminating system comprising a lamp emitting illuminating light of a high intensity; a reflecting optical member provided with a reflecting face surrounding the lamp and further provided at an end with a window for transmitting the light from the reflecting face and at the other end with an aperture for passing a part of the lamp; a casing integrally housing the reflecting optical member and the lamp and provided with a ventilating hole in a part of the casing for communication with the exterior; and air guide means for connecting the ventilating hole with an air path connecting the light transmitting window of the reflecting optical member with the aperture thereof.

DESCRIPTION OF THE PREFERRED EMBODIMENTS

Figure 1:
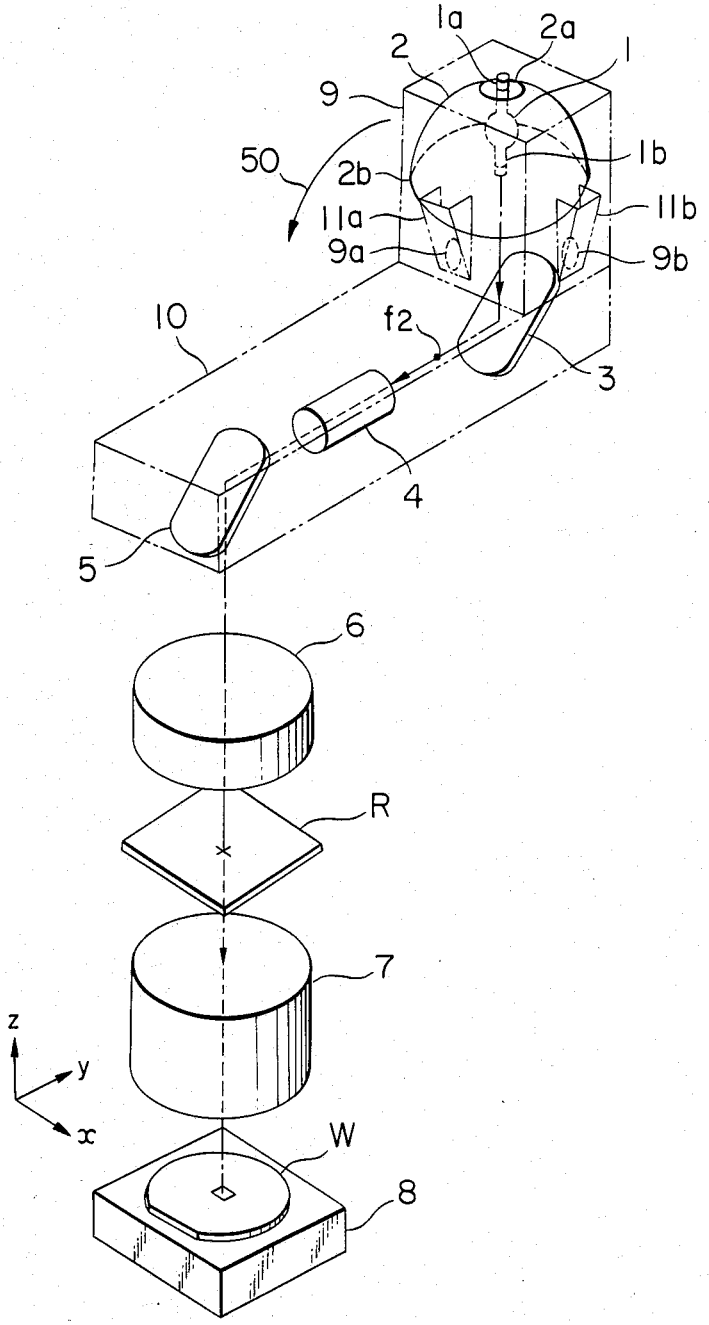
FIG. 1 is a schematic view showing optical arrangement of a projection exposure apparatus embodying the present invention.

FIG. 1 shows a projection exposure apparatus embodying the present invention, wherein a light source 1 utilizing a high-pressure mercury arc lamp is vertically positioned inside a spheroidal reflector 2 of umbrella shape, internally having a reflective evaporated coating. Said light source 1 is so positioned that the arc between the discharge electrodes coincides with a first focal point of the spheroid of the reflector 2. The reflector 2 is provided with an aperture for passing a part of the lamp wall of the light source 1 adjacent to an upper metal mount 1*a*. Among the light emitted by the arc lamp 1, that reflected by the internal face of the reflector 2 emerges from a window 2*b* at the lower end of the reflector 2, then reflected by a dichroic mirror 3 and is focused at a second focal point $f_2$ of the spheroidal reflector 2. The light from the mirror 3 then enters an optical member 4 comprising an interference filter for efficiently transmitting the light of determined wavelength such as of g- or i-line and intercepting the light of other wavelengths, and an optical integrator such as a fly's eye lens for producing plural secondary images of the light source from the image at the second focal point $f_2$. The illuminating light beam emerging from the optical member 4 is reflected downwards by a mirror 5. A condenser lens 6, functioning in cooperation with the optical member 4, obtains a uniform intensity distribution in the illuminating light beam from the mirror 5, and directs the light beam to a photo-mask or reticle (hereinafter collectively called a reticle R) bearing a desired circuit pattern. A projection optical system 7 projects the pattern of the reticle R with a determined magnification onto a wafer W, and the image of the pattern of the reticle R is printed on the wafer W, by means of photoresist coated on the wafer W and sensitive to the illuminating light beam. The wafer W is placed on a stage 8 which is two-dimensionally movable along mutually orthogonal x-and y-directions. The stage 8 is retracted from the position directly below the projection optical system 7 in case of the loading and unloading of the wafer, and is adapted to perform stepping motion for forming an array of plural images of the pattern of the reticle in the step-and-repeat exposures. In such exposure apparatus, the light source 1 and the reflector 2 are almost totally enclosed in a lamp case 9, and the dichroic mirror 3, optical member 4 and mirror 5 are also totally enclosed in a case 10 which communicates with the lamp case 9 at the lower end thereof. In the present embodiment, the lamp case 9 is provided with ventilating holes 9*a*, 9*b*, 9*c* communicating with the exterior respectively on three side walls of the lamp case. In FIG. 1 there are only shown the ventilating hole 9*a* formed on the front side wall and the ventilating hole 9*b* formed on the right side wall. The ventilating hole 9*c* is formed on the left side wall of the lamp case 9, at an opposed position to the hole 9*b*. These three ventilating holes 9*a*, 9*b*, 9*c* are formed lower than the light emitting window 2*b* of the reflector 2 and at the same level with the lower metal mount 1*b*. The ventilating holes 9*a*, 9*b*, 9*c* are covered by wedge-shaped shield members 11*a*, 11*b*, 11*c* extending upwards along the side walls of the lamp case 9, the shield member 11*c* being unrepresented in FIG. 1. Each of the shield members 11*a*, 11*b*, 11*c* has a small distance to the side wall of the lamp case 9 at a position facing the ventilating hole 9*a*, 9*b* or 9*c* but has a gradually increasing distance in the upper part and is provided with an aperture at the upper end.

The dichroic mirror 3, optical member 4 and mirror 5 are mounted on an unrepresented base plate for maintaining a determined optical arrangement. The base plate has a laminated structure of plural layers, one of which is provided with a water-cooling pipe so as to surround the base plate. By supplying water of a determined temperature (ca. 20° C.) in the pipe, it is rendered possible to prevent the temperature rise of the base plate and to achieve a heat insulating effect for protecting the lower part of the case 10, particularly the optical and mechanical systems below the mirror 5 from the heat of the light source 1.

Figure 2:
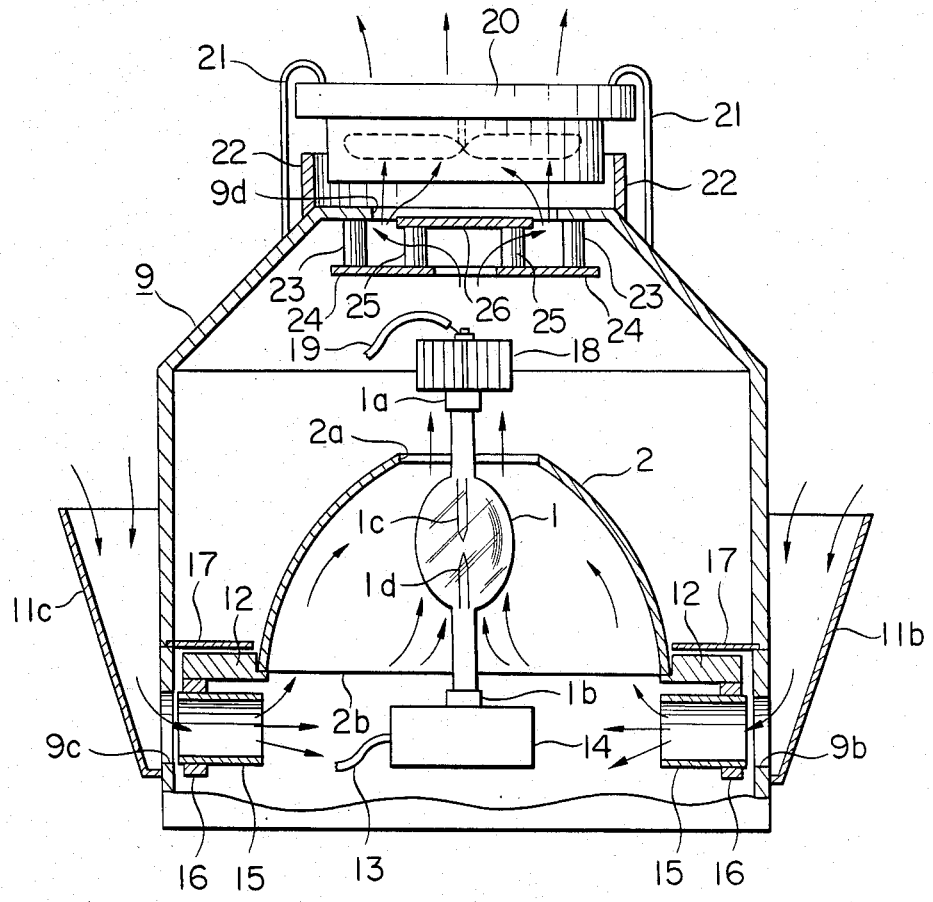
FIG. 2 is a cross-sectional view showing the structure in the lamp case.

FIG. 2 shows the detailed structure of the lamp case 9. The light-emitting window 2*b* of the reflector 2 is supported by a support member 12, which is so designed as not to intercept the light from said window 2*b*. The lower metal mount 1*b* of the light source 1 is supported by a lamp holder 14, which also serves for electrical connection with a lead wire 13. The lamp holder 14 and support member 12 are integrally fixed by a known method. On the lower face of the support member 12 there is provided a fixing element 16 for horizontally supporting cylindrical ducts 15. The ducts 15 are provided in three positions respectively corresponding to the ventilating holes 9*a*, 9*b*, 9*c* of the lamp case 9 in such a manner that an end of each duct 15 is positioned close to or in contact with the ventilating hole 9*a*, 9*b* or 9*c* while the other end of each duct is positioned close to the extremity of the light-emitting window 2*b* without intercepting the illuminating light.

Above the support member 12 there is provided an air shield plate 17 for horizontally surrounding the reflector 2. The air shield plate 17 is provided at the center thereof with a circular aperture which is in contact with or is positioned close to the external periphery of the reflector 2 close to the light-emitting window 2*b*, and the external periphery of said air shield plate 17 has a shape corresponding to the internal walls of the lamp case 9 and is in contact with or is positioned close thereto. The air shield plate 17 has a function of separating an upper space and a lower space in the lamp case 9 with a boundary in the vicinity of the light-emitting window 2*b* and guiding the air from the ducts 15 effectively into the reflector 2, preventing the entry of the air into the space between the external periphery of the reflector 2 and the internal walls of the lamp case 9.

The upper aperture 2*a* of the reflector 2 has a diameter larger than the maximum diameter of the lamp tube corresponding to a pair of electrodes 1*c*, 1*d* for forming the arc, thereby allowing the passage of the glass tube of the light source 1 and facilitating the replacement thereof. The upper metal mount 1*a* is equipped with a radiator 18 having plural radial fins and is further connected to a lead wire 19.

The upper wall of the lamp case 9 is provided with a hole 9*d* for discharging the air in the lamp case 9, and an electric fan 20 of a size covering the hole 9*d* is provided thereon. The fan 20 is suspended by plural piano wires 21 vertically extending from the lamp case 9, in order that the fan 20 does not contact with the lamp case 9. Consequently the vibration of the fan 20 is not directly transmitted to the lamp case 9. The fan 20 is so driven as to forcedly discharge the air from the lamp case 9 through the hole 9*d*. An annular cover 22 is provided in a space between the lower face of the fan 20 and the periphery of the hole 9*d*, in order to enhance the air-discharging efficiency of the fan.

The light may leak through the aperture 2*a* of the reflector 2 and the hold 9*d* positioned above the light source 1. In order to prevent such leak, an annular light shield plate 24 having a circular aperture is fixed by means of plural rod-shaped spacers 23 mounted around the hole 9*d*, and a circular light shield plate 26 smaller than the hole 9*d* in a position opposed to the circular aperture by means of plural spacers 25 mounted around the circular aperture of the light shield plate 24.

The lamp case 9 is constructed separate from the case 10 and is connected thereto by a hinge in such a manner that the lamp case 9 can be made to topple in a direction 50 shown in FIG. 1, in case of replacing the light source 1. The air shield plate 17, light shield plates 24, 26 and fan 20 move together with the lamp case 9. It is therefore desirable not to fix the support member 12, fixing member 16 and ducts 15 to the lamp case 9 or the air shield plate 17.

When the light source 1 is continuously activated with a determined input electric power in the above-described structure, the arc-generating electrodes 1*c*, 1*d*, lamp wall and metal mounts 1*a*, 1*b* reach a temperature of several hundred degrees, and the space inside the reflector also reaches a considerably high temperature. By activating the fan 20 at a determined revolution, air is inhaled from the upper apertures of the light shield members 11*a*, 11*b*, 11*c* through the ducts 15. In general the exposure apparatus of this sort is installed in an atmosphere of a controlled temperature of 20° or 25° C., so that the air inhaled through the ducts 15 is of a temperature same as that of the surrounding atmosphere. The inhaled air flows toward the lower metal mount 1*b* and the lamp holder 14. However the flow rate of the air is principally determined by the capacity of the fan 20 and is not so large in comparison with the conventional structure in which air is forcedly blown to the metal mount from a nozzle. The use of large air-emitting apertures as in the ducts 15, instead of a highly directive nozzle, enables not only to guide the air toward the lower metal mount 1*b* and lamp holder 14 but also to the interior of the reflector 2. The air from the ducts 15 flows the interior of the reflector 2 from the light-emitting window 2b to the upper aperture 2a, thus cooling the entire apparatus including not only the light source but also the reflector 2, and also cools the radiator 18 after passing the aperture 2a.

The number and dimension of the ventilating holes of the lamp case 9 and of the ducts 15 should be so determined that a suitable amount of air reaches the light source, in relation to the internal volume of the lamp case 9 and the capacity of the fan 20. The desired cooling effect can also be achieved with the air shield plate 17 alone, without the ducts 15 employed in the present embodiment. It is also effective to provide the ducts 15 with variable diaphragms for varying the cross section thereof, thus achieving optimum cooling effect.

Figure 3:
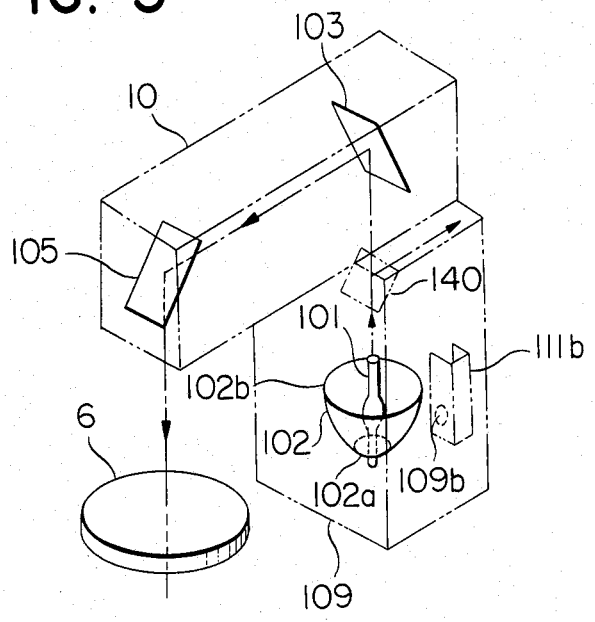
FIG. 3 is a perspective view schematically showing an exposure apparatus showing a second embodiment of the present invention.
Figure 4:
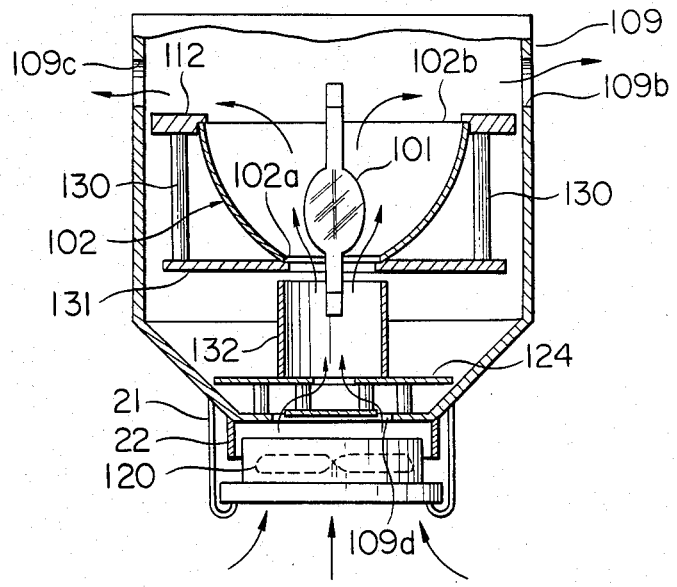
FIG. 4 is a cross-sectional view showing the structure in the lamp case of the second embodiment.

Now reference is made to FIGS. 3 and 4 for explaining a second embodiment of the present invention. FIG. 3 shows a light source apparatus in which the illuminating light beam is emitted upwards from a vertically inverted spheroidal reflector 102, then diverted to the front by a dichroic mirror 103 and is reflected downwards by a mirror 105 towards a condenser lens 6 positioned below. In this apparatus the cooling condition is less critical than in the foregoing embodiment, since the light-emitting aperture 102b of the reflector 102 is positioned above the aperture 102a thereof. As in the foregoing embodiment, the lamp case 109 is provided, on the side wall thereof, with a ventilating hole 109b covered by a light shield member 111b. FIG. 4 shows the detailed structure inside the lamp case, with the reflector 102 positioned as explained above. In addition to the components shown in FIG. 2, there are further provided plural spacers 130 mounted on the lower face of the support member 112; a support member 131 fixed on said spacers 130 for supporting the reflector at the aperture 102a; an annular light shield plate 124 having an external periphery close to or in contact with the internal walls of the lamp case; and an air guide pipe 132 mounted around a circular aperture of the light shield plate 124. In the above-described structure, the air is emitted upwards by the fan 120, then flows through the hole 109d, circular aperture of the annular light shield plate 124, air guide pipe 132, aperture 102a and light-emitting aperture 102b, and is discharged to the exterior through the ventilating holes 109b, 109c and light shield members 111b, 111c. In this structure, the air guide pipe 132 has the same function and effect as those of the aforementioned air shield plate 17. In the present embodiment, it is also possible to employ small fans at the ventilating holes 109b, 109c for forcedly dischaging the hot air to the exterior, instead of the fan 120 provided at the lower end of the lamp case.

In the present embodiment, the hot air coming from the light source may rise vertically toward the dichroic mirror 103, mirror 105 and further toward the condenser lens 6. It is therefore desirable to horizontally position a glass plate of a high transmission to the illuminating light beam between the dichroic mirror 103 and the reflector 102, more specifically above the ventilating holes 109b, 109c, thereby intercepting the hot air rising from the light source and guiding it efficiently to the ventilating holes 109b, 109c. It is furthermore possible, as shown by broken lines in FIG. 3, to provide a dichroic mirror 140 for vertically transmitting the components of actinic wavelength for exposure of the illuminating light beam from the light source while reflecting other components of unnecessary wavelengths and to form an image of the light source by focusing said reflected components, wherein the position of said image can be utilized for adjusting the position of the arc of the light source to the first focal point of the spheroidal reflector. In such arrangement, the dichroic mirror 140 can be utilized in the same manner as the above-mentioned glass plate.

Though the foregoing two embodiments employ spheroidal reflectors, the present invention is also similarly effective in an illuminating system utilizing a parabolic mirror or employing a condenser system composed of lenses, prisms, mirrors etc. positioned around the light source.

What is claimed is:

1. An illuminating system comprising:

a light-emitting lamp;

a reflecting optical member provided with a reflecting face surrounding a space around said lamp and further provided at one end with a light-emitting aperture for emitting the light of said lamp through said reflecting face to the exterior of the reflecting optical member and at the other end with another aperture for passing a part of said lamp, said reflecting optical member having an optical axis passing through said light-emitting aperture and said another aperture, and the diameter of said light-emitting aperture being larger than the diameter of said another aperture;

a case member for accommodating said lamp and said reflecting optical member for separating the interior of said case member from the exterior thereof, provided with at least an intake hole and an exhaust hole for communicating the exterior with the interior of said case member, said intake hole being provided near said light-emitting aperture and said exhaust hole being provided at a position facing said another aperture;

air guide means provided inside said case member for connecting said intake hole with an air flow path passing through said light-emitting aperture and said another aperture, said air guide means having a tubular member disposed in a radial direction relative to said optical axis between said intake hole and the periphery of said light-emitting aperture; and an air fan provided at said exhaust hole for generating an air flow from said intake hole to said exhaust hole through said tubular member and said air flow path.

2. An illuminating system according to claim 1, further comprising a light shielding member provided between said light-emitting lamp and said fan for preventing the light emitted by said light-emitting lamp from leaking through said exhaust hole and reaching said air fan.

3. An illuminating system according to claim 2, wherein said light shielding member includes plural light shield plates disposed across said optical axis and mutually spaced in the direction of said optical axis.

4. An illuminating system according to claim 1, wherein said air guide means comprises an air shield plate positioned along a plane separating the internal space of said case member into a first space including the light-emitting aperture of said reflecting optical member and a second space including said another aperture, and wherein said intake hole is positioned opposed to said first space.

* * * * *